US011518020B2

(12) United States Patent
Macor

(10) Patent No.: US 11,518,020 B2
(45) Date of Patent: Dec. 6, 2022

(54) POCKET SCREWDRIVER

(71) Applicant: Richard J. Macor, Easton, PA (US)

(72) Inventor: Richard J. Macor, Easton, PA (US)

(73) Assignee: Proprietary Technologies, Inc., Easton, PA (US)

( * ) Notice: Subject to any disclaimer, the term of this patent is extended or adjusted under 35 U.S.C. 154(b) by 363 days.

(21) Appl. No.: 16/873,720

(22) Filed: Jun. 12, 2020

(65) Prior Publication Data

US 2021/0387320 A1 Dec. 16, 2021

(51) Int. Cl.

| | |
|---|---|
| ***B25G 1/08*** | (2006.01) |
| ***B25B 23/16*** | (2006.01) |
| ***B25B 15/00*** | (2006.01) |
| ***B25B 23/00*** | (2006.01) |

(52) U.S. Cl.

CPC ..... *B25G 1/085* (2013.01); *B25B 15/004* (2013.01); *B25B 23/0035* (2013.01); *B25B 23/16* (2013.01)

(58) Field of Classification Search

CPC ..... B25G 1/085; B25B 15/004; B25B 15/02; B25B 23/0035; B25B 23/16; B25F 1/02; B25F 1/04

See application file for complete search history.

(56) References Cited

U.S. PATENT DOCUMENTS

| | | | | | |
|---|---|---|---|---|---|
| 4,300,607 | A * | 11/1981 | Mellinger | B25B 15/02 | 81/490 |
| 5,442,982 | A * | 8/1995 | Bell | B25G 1/085 | 81/439 |
| D373,061 | S * | 8/1996 | Macor | D8/82 | |
| 5,592,862 | A * | 1/1997 | Macor | B25B 15/02 | 81/439 |
| D380,363 | S * | 7/1997 | Macor | D8/83 | |
| 6,494,121 | B1 * | 12/2002 | Hu | B25B 23/0042 | 81/439 |
| 7,052,128 | B1 * | 5/2006 | Kung-Ping | B25B 15/02 | 81/439 |
| 7,255,028 | B1 * | 8/2007 | Di Bitonto | B25B 15/02 | 81/492 |

* cited by examiner

*Primary Examiner* — David B. Thomas

(57) ABSTRACT

A pair of screwdrivers each having a handle, a nondetachable outer shaft, a detachable inner shaft, and at least two detachable double-ended screwdriver bits. Each screwdriver handle is formed having a hollow space configured to substantially house the outer screwdriver shaft, the inner screwdriver shaft, and the at least two double-ended screwdriver bits of the other screwdriver, whereby, the pair of screwdrivers may be assembled together when not in use so that the outer shaft, the inner shaft, and the at least two double-ended screwdriver bits of both screwdrivers are substantially non-exposed to prevent the potential for accidental user injury.

20 Claims, 3 Drawing Sheets

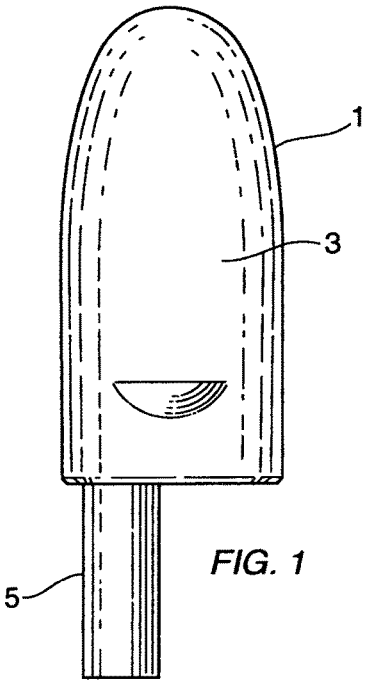
FIG. 1
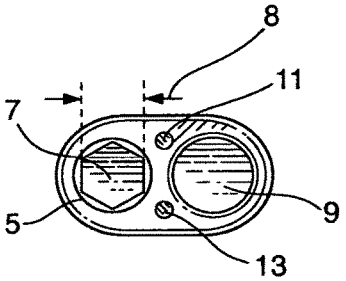
FIG. 2
FIG. 5
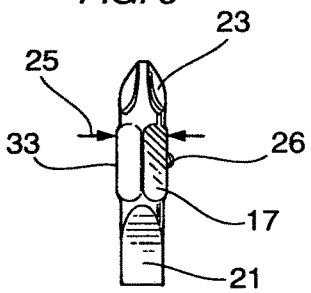
FIG. 3
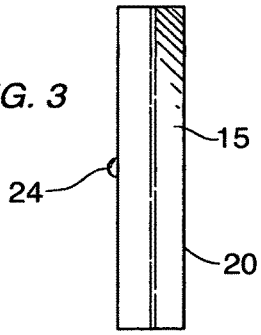
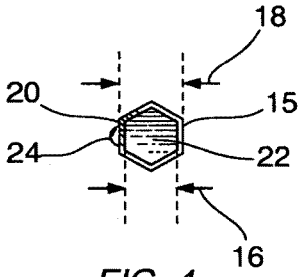
FIG. 4
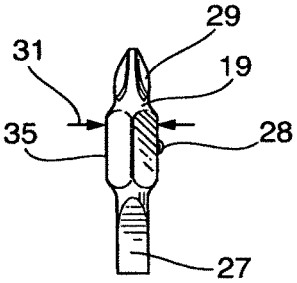
FIG. 6

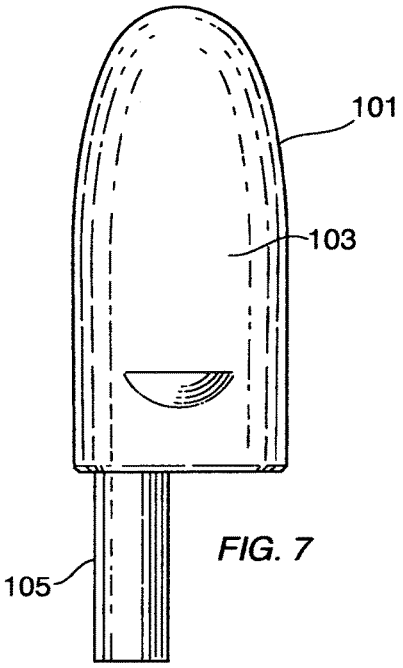
FIG. 7
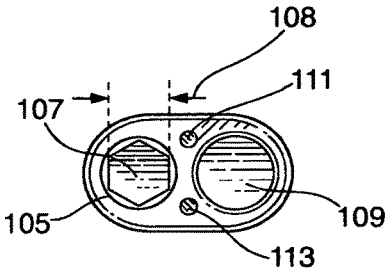
FIG. 8
FIG. 11
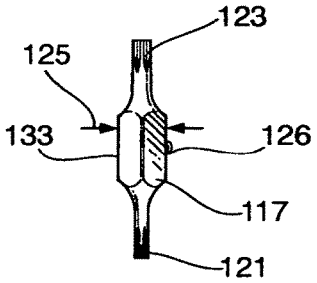
FIG. 9
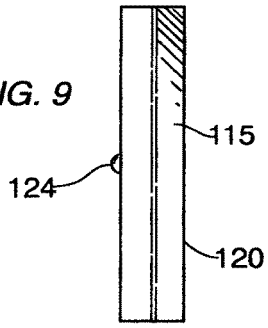
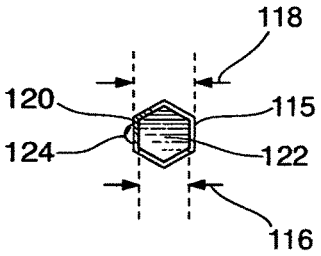
FIG. 10
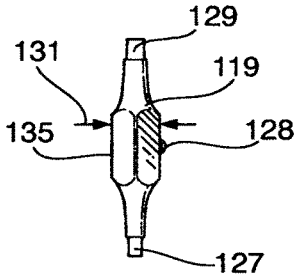
FIG. 12

POCKET SCREWDRIVER

REFERENCES TO RELATED APPLICATIONS

This patent application may relate to one or more of the following patents granted to the inventor herein including U.S. Pat. Nos. D380,363; 5,592,862; and D373,061.

This application relates to and is a Continuation-in-part of co-pending U.S. patent application Ser. No. 16/602,949 filed on Dec. 31, 2019 entitled POCKET SCREWDRIVER, which is a Continuation-in-part of U.S. application Ser. No. 29/742,081 filed on Nov. 25, 2019.

FIELD OF THE INVENTION

The present invention relates to screwdrivers, particularly screwdrivers that may be carried and transported in a user's pocket.

BACKGROUND OF THE INVENTION

Traditional prior-art screwdrivers have a handle, a shaft and an exposed working tip which is usually pointed and sharp. Accordingly, if a user carries a screwdriver in their pocket, or attempts to find and grab a screwdriver out of a packed toolbox, kitchen drawer, vehicle glovebox, pocketbook etc., there's a possibility the user may be injured from the exposed pointed sharp screwdriver tip.

Certainly, screwdrivers can be improved to reduce the possibility of users stabbing and/or injuring themselves from the exposed pointed sharp tip if carried in a pocket and/or grabbed from a packed toolbox, kitchen drawer, vehicle glovebox, pocketbook, etc.

SUMMARY OF THE INVENTION

A pair of screwdrivers each having a handle, a nondetachable outer shaft, a detachable inner shaft, and at least two detachable double-ended screwdriver bits. Each screwdriver handle is formed having a hollow space configured to substantially house the outer screwdriver shaft, the inner screwdriver shaft, and the at least two double-ended screwdriver bits of the other screwdriver, whereby, the pair of screwdrivers may be assembled together when not in use so that the outer shaft, the inner shaft, and the at least two double-ended screwdriver bits of both screwdrivers are substantially non-exposed to prevent the potential for accidental user injury.

It is an objective of the present invention pair of screwdrivers that it does not have any sharp or pointed parts substantially exposed when not in use, so that it may be safely carried in a user's pocket.

It is another objective of the present invention that it does not have any sharp or pointed parts exposed when not in use, so that it may be safely grabbed out of a packed toolbox, kitchen drawer, car glovebox, and/or pocketbook etc.

It is another objective of the present invention described herein that it has multiple nut-driver shafts and multiple screwdriver tips to turn multiple types of screws, nuts, and bolts.

It is another objective of the present invention described herein that it has at least two different nut-driver shafts and at least eight different screwdriver tips to turn multiple types of screws, nuts, and bolts.

It is another objective of the present invention that it provides users with enhanced turning leverage to aid old and/or weak users who may have weak hands and/or wrists.

It is another objective of the present invention that it be ergonomic and comfortable to use.

It is another objective of the present invention that it be simple in design.

It is another objective of the present invention that it be durable under extended use.

It is another objective of the present invention that it be commercially viable and cost-efficient to manufacture.

BRIEF DESCRIPTION OF THE DRAWINGS

The present invention is more fully understood when the specification herein is taken in conjunction with the drawings appended hereto, wherein:

FIG. 1 shows a top view of an example embodiment of the handle and outer shaft of the first of two screwdrivers in the present invention pair of screwdrivers;

FIG. 2 shows a bottom view of the screwdriver shown in FIG. 1 including an end view of the outer screwdriver shaft;

FIG. 3 shows a top view of the inner screwdriver shaft;

FIG. 4 shows an end view of the inner screwdriver shaft shown in FIG. 3;

FIG. 5 shows a top view of a double-ended screwdriver bit that has a screwdriver tip at each end thereof;

FIG. 6 shows a top view of another double-ended screwdriver bit that has a screwdriver tip at each end thereof;

FIG. 7 shows a top view of an example embodiment of the handle and outer shaft of the second of two screwdrivers in the present invention pair of screwdrivers;

FIG. 8 shows a bottom view of the screwdriver shown in FIG. 7 including an end view of the outer screwdriver shaft;

FIG. 9 shows a top view of the inner screwdriver shaft;

FIG. 10 shows an end view of the inner screwdriver shaft shown in FIG. 9;

FIG. 11 shows a top view of a double-ended screwdriver bit that has a screwdriver tip at each end thereof;

FIG. 12 shows a top view of another double-ended screwdriver bit that has a screwdriver tip at each end thereof;

DETAILED DESCRIPTION OF THE DRAWINGS

Figure 13:
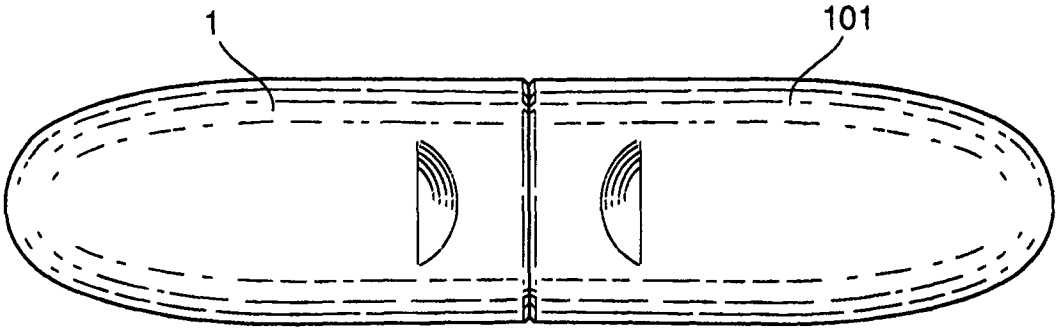
FIG. 13 shows a top view of the present invention pair of screwdrivers assembled and detachably secured together.

The various drawings provided herein are for the purpose of illustrating examples of the present invention and not for the purpose of limiting same. Therefore, the drawings herein represent only a few of the many possible examples, embodiments, variations and/or applications of the present invention.

Referring now to FIGS. 1, 2, 3, 4, 5, and 6 together, FIG. 1 shows a top view of an example embodiment of the handle and outer shaft of the first of two screwdrivers in the present invention pair of screwdrivers; and, FIG. 2 shows a bottom view of the screwdriver shown in FIG. 1 including an end view of the outer screwdriver shaft; and, FIG. 3 shows a top view of the inner screwdriver shaft; and, FIG. 4 shows an end view of the inner screwdriver shaft shown in FIG. 3; and, FIG. 5 shows a top view of a double-ended screwdriver bit that has a screwdriver tip at each end thereof; and, FIG. 6 shows a top view of another double-ended screwdriver bit that has a screwdriver tip at each end thereof. Screwdriver 1 has a handle 3, a nondetachable outer shaft 5, a detachable inner shaft 15, and at least two detachable double-ended screwdriver bits 17 and 19. Screwdriver handle 3 is formed having a hollow space 9 seen best in FIG. 2 configured to substantially house the outer screwdriver shaft 105 shown in FIGS. 7 and 8, the inner screwdriver shaft 115 shown in FIG. 9, and the at least two double-ended screwdriver bits 117 and 119 shown in FIGS. 11 and 12 respectively of the second screwdriver 101 shown in FIG. 7, whereby, the pair of screwdrivers 1 and 101 shown in FIGS. 13 and 14 may be assembled together when not in use so that the outer shaft, the inner shaft, and the at least two double-ended screwdriver bits of both screwdrivers are substantially non-exposed to prevent the potential for accidental user injury In FIGS. 1 and 2 outer screwdriver shaft 5 extends out of and is nondetachable from handle 3. Outer screwdriver shaft 5 has a hexagonally shaped opening 7 with an inner diameter 8 when viewed from an end view thereof which is best seen in FIG. 2.

In FIGS. 3 and 4 detachable inner screwdriver shaft 15 has a hexagonally shaped opening at each end thereof such as 22 with an outer diameter 18 and an inner diameter 16 when viewed from an end view thereof which is best seen in FIG. 4. The outer diameter 18 of inner screwdriver shaft 15 is less than the inner diameter 8 of outer screwdriver shaft 5 so that inner screwdriver shaft 15 may be detachably inserted into and out of the hexagonally shaped opening 7 of outer screwdriver shaft 5. Inner screwdriver shaft 15 is frictionally secured within outer screwdriver shaft 5 via spring-loaded ball 24 protruding from inner shaft 15. It is preferable that the inner screwdriver shaft of each screwdriver in the present invention pair of screwdrivers be formed with a means by which it may be detachably secured within the outer screwdriver shaft of the screwdriver. Accordingly, spring loaded ball 24 is the means by which inner screwdriver shaft 15 is detachably secured within outer screwdriver shaft 5. Also, inner screwdriver shaft 15 is formed with an outer configuration 20 seen best in FIG. 4 which prevents rotation within the hexagonally shaped opening 7 of outer screwdriver shaft 5.

Each of the at least two detachable double-ended screwdriver bits 17 and 19 have an outer diameter 25 and 31 respectively. The outer diameter of each screwdriver bit is less than the inner diameter 16 of inner screwdriver shaft 15 so that each screwdriver bit 17 and 19 may be detachably inserted into and out of the hexagonally shaped opening such as 22 at either end of inner screwdriver shaft 15. Each double-ended screwdriver bit 17 and 19 is further formed with an outer configuration that prevents rotation of the screwdriver bit within the hexagonally shaped opening such as 22 at either end of inner screwdriver shaft 15. Accordingly, screwdriver bit 17 has an outer hexagonal configuration 33 which prevents rotation of double-ended screwdriver bit 17 within inner screwdriver shaft 15; and, screwdriver bit 19 has an outer hexagonal configuration 35 which prevents rotation of double-ended screwdriver bit 19 within inner screwdriver shaft 15. Each of the at least two double-ended screwdriver bits 17 and 19 have two screwdriver tips, one at each end thereof. Double-ended screwdriver bit 17 has a slotted tip 21 and a Phillips-type tip 23. Double-ended screwdriver bit 19 has a smaller slotted tip 27 (than slotted tip 21) and a smaller Phillips-type tip 29 (than Phillips-type tip 23). Screwdriver bits 17 and 19 are each formed to be detachably secured within one end of inner screwdriver shaft 15 with one tip exposed for usage. The assembly of inner screwdriver shaft 15 and double-ended screwdriver bits 17 and 19 is configured to be detachably secured within the hexagonal opening 7 of outer screwdriver shaft 5. Double-ended screwdriver bit 17 is frictionally secured within one end of inner screwdriver shaft 15 via spring-loaded ball 26; and, double-ended screwdriver bit 19 is frictionally secured within one end of inner screwdriver shaft 15 via spring-loaded ball 28. It is preferable that each double-ended screwdriver bit of each screwdriver in the present invention pair of screwdrivers be formed with a means by which it may be detachably secured within an end of the inner screwdriver shaft with one end of the screwdriver bit exposed for usage thereof.

Screwdriver 1 which is the first of the two screwdrivers in the present invention pair of screwdrivers has two different nut-driver hexagonal openings 7 and 22 which may be used to engage and turn screws, nuts and bolts etc.; and, four different screwdriver tips 21, 23, 27 and 29 which may be used to engage and turn four different type and/or size screws, nuts, and bolts etc. A user would simply remove the exposed screwdriver bit 17 or 19 temporarily to expose the nut-driver hexagonal opening 22 of inner screwdriver shaft 15 for use. And, if the assembly of inner screwdriver shaft 15 and double-ended screwdriver bits 17 and 19 are removed from screwdriver 1, then nut-driver hexagonal opening 7 may be used to engage and turn screws nuts and bolts etc.

Figure 14:
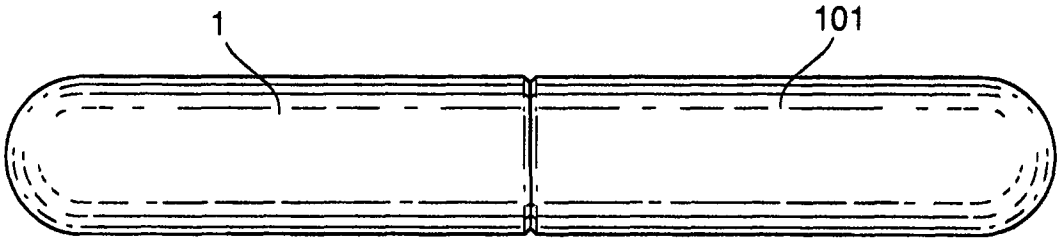
FIG. 14 shows a front view of the present invention pair of screwdrivers shown in FIG. 13.

First screwdriver 1 has metal pins 11 and 13 (seen best in FIG. 2) which are attracted to corresponding magnets 111 and 113 of the second screwdriver 101 of the present invention (seen best in FIG. 8) by which the pair of screwdrivers 1 and 101 are detachably secured together without any sharp or pointed parts exposed as seen in FIGS. 13 and 14. It is preferable that at least one screwdriver in the pair of screwdrivers of the present invention be formed having a means by which the pair of screwdrivers may be detachably secured together when assembled. In this embodiment of the present invention a magnetic means is used to detachably secure the present invention pair of screwdrivers 1 and 101 together when assembled. Of course, a mechanical means such as a spring-loaded ball or other frictional means could be utilized as a means by which the pair of screwdrivers may be detachably secured together when assembled.

Referring now to FIGS. 7, 8, 9, 10, 11, and 12 together, FIG. 7 shows a top view of an example embodiment of the handle and outer shaft of the second of two screwdrivers in the present invention pair of screwdrivers; and, FIG. 8 shows a bottom view of the screwdriver shown in FIG. 7 including an end view of the outer screwdriver shaft; and, FIG. 9 shows a top view of the inner screwdriver shaft; and, FIG. 10 shows an end view of the inner screwdriver shaft shown in FIG. 9; and, FIG. 11 shows a top view of a double-ended screwdriver bit that has a screwdriver tip at each end thereof; and, FIG. 12 shows a top view of another double-ended screwdriver bit that has a screwdriver tip at each end thereof. Screwdriver 101 has a handle 103, a nondetachable outer shaft 105, a detachable inner shaft 115, and at least two detachable double-ended screwdriver bits 117 and 119. Screwdriver handle 103 is formed having a hollow space 109 seen best in FIG. 8 configured to substantially house the outer screwdriver shaft 5 shown in FIGS. 1 and 2, the inner screwdriver shaft 15 shown in FIG. 3, and the at least two double-ended screwdriver bits 17 and 19 shown in FIGS. 5 and 6 respectively of the first screwdriver 1 shown in FIG. 1, whereby, the pair of screwdrivers 1 and 101 shown in FIGS. 13 and 14 may be assembled together when not in use so that the outer shaft, the inner shaft, and the at least two double-ended screwdriver bits of both screwdrivers are substantially non-exposed to prevent the potential for accidental user injury.

In FIGS. 7 and 8 outer screwdriver shaft 105 extends out of and is nondetachable from handle 103. Outer screwdriver shaft 105 has a hexagonally shaped opening 107 with an inner diameter 108 when viewed from an end view thereof which is best seen in FIG. 8.

In FIGS. 9 and 10 detachable inner screwdriver shaft 115 has a hexagonally shaped opening at each end thereof such as 122 with an outer diameter 118 and an inner diameter 116 when viewed from an end view thereof which is best seen in FIG. 10. The outer diameter 118 of inner screwdriver shaft 115 is less than the inner diameter 108 of outer screwdriver shaft 105 so that inner screwdriver shaft 115 may be detachably inserted into and out of the hexagonally shaped opening 107 of outer screwdriver shaft 105. Inner screwdriver shaft 115 is frictionally secured within outer screwdriver shaft 105 via spring-loaded ball 124 protruding from inner shaft 115. It is preferable that the inner screwdriver shaft of each screwdriver in the present invention pair of screwdrivers be formed with a means by which it may be detachably secured within the outer screwdriver shaft of the screwdriver. Accordingly, spring loaded ball 124 is the means by which inner screwdriver shaft 115 is detachably secured within outer screwdriver shaft 105. Also, inner screwdriver shaft 115 is formed with an outer configuration 120 seen best in FIG. 10 which prevents rotation within the hexagonally shaped opening 107 of outer screwdriver shaft 105.

Each of the at least two detachable double-ended screwdriver bits 117 and 119 have an outer diameter 125 and 131 respectively. The outer diameter of each screwdriver bit is less than the inner diameter 116 of inner screwdriver shaft 115 so that each screwdriver bit 117 and 119 may be detachably inserted into and out of the hexagonally shaped opening at either end of inner screwdriver shaft 115 such as 122. Each double-ended screwdriver bit 117 and 119 is further formed with an outer configuration that prevents rotation of the screwdriver bit within the hexagonally shaped opening at either end of inner screwdriver shaft 115 such as 122. Accordingly, screwdriver bit 117 has an outer hexagonal configuration 133 which prevents rotation of double-ended screwdriver bit 117 within inner screwdriver shaft 115; and, screwdriver bit 119 has an outer hexagonal configuration 135 which prevents rotation of double-ended screwdriver bit 119 within inner screwdriver shaft 115. Each of the at least two double-ended screwdriver bits 117 and 119 have two screwdriver tips, one at each end thereof. Double-ended screwdriver bit 117 has a small TORX type tip 121 and a larger TORX type tip 123. Double-ended screwdriver bit 119 has a small square-recess type tip 127 and a larger square-recess type tip 129. Screwdriver bits 117 and 119 are each formed to be detachably secured within one end of inner screwdriver shaft 115 with one tip exposed for usage. The assembly of inner screwdriver shaft 115 and double-ended screwdriver bits 117 and 119 is configured to be detachably secured within the hexagonal opening 107 of outer screwdriver shaft 105 with one screwdriver tip exposed for use. Double-ended screwdriver bit 117 is frictionally secured within inner screwdriver shaft 115 via spring-loaded ball 126; and, double-ended screwdriver bit 119 is frictionally secured within one end of inner screwdriver shaft 115 via spring-loaded ball 128. It is preferable that each double-ended screwdriver bit of each screwdriver in the present invention pair of screwdrivers be formed with a means by which it may be detachably secured within an end of the inner screwdriver shaft with one end of the screwdriver bit exposed for usage thereof.

Screwdriver 101 which is the second of the two screwdrivers in the present invention pair of screwdrivers has two different nut-driver hexagonal openings 107 and 122 which may be used to engage and turn screws, nuts and bolts etc.; and, four different screwdriver tips 121, 123, 127 and 129 which may be used to engage and turn four different type and/or size screws, nuts, and bolts etc. A user would simply remove the exposed screwdriver bit 117 or 119 temporarily to expose nut-driver hexagonal opening 122 of inner screwdriver shaft 115 for use. And, if the assembly of inner screwdriver shaft 115 and double-ended screwdriver bits 117 and 119 are removed from screwdriver 101, then nut-driver hexagonal opening 107 may be used to engage and turn screws nuts and bolts etc. The nut-driver hexagonal openings 107 and 122 of screwdriver 101 may be the same as, or different than, the nut-driver hexagonal openings 7 and 22 of screwdriver 1.

Second screwdriver 101 has pin magnets 111 and 113 (seen best in FIG. 8) which are attracted to corresponding metal pins 11 and 13 of the first screwdriver 1 of the present invention (seen best in FIG. 2) by which the pair of screwdrivers 1 and 101 are detachably secured together without any sharp or pointed parts exposed as seen in FIGS. 13 and 14. It is preferable that at least one screwdriver in the pair of screwdrivers of the present invention be formed having a means by which the pair of screwdrivers may be detachably secured together when assembled. In this embodiment of the present invention a magnetic means is used to detachably secure the present invention pair of screwdrivers 1 and 101 together when assembled. Of course, a mechanical means such as a spring-loaded ball or other frictional means could be utilized as a means by which the pair of screwdrivers may be detachably secured together when assembled.

Referring now to FIGS. 13 and 14 together, FIG. 13 shows a top view of the present invention pair of screwdrivers 1 and 101 assembled and detachably secured together; and, FIG. 14 shows a front view of the present invention pair of screwdrivers shown in FIG. 13. As shown in FIGS. 13 and 14 the pair of screwdrivers 1 and 101 are assembled together when not in use so that the outer shaft, the inner shaft, and the at least two double-ended screwdriver bits of both screwdrivers are substantially non-exposed to prevent the potential for accidental user injury.

When assembled together the shape of the pair of screwdrivers 1 and 101 may be any shape whatsoever, however, preferred embodiments of the present invention pair of screwdrivers have a silhouette shape when viewed from a top view thereof, and that shape is substantially an elongated ellipse as seen in FIG. 13.

Upon reading and understanding the specification of the present invention described above, modifications and alterations will become apparent to those skilled in the art. It is intended that all such modifications and alterations be included insofar as they come within the scope of the patent as claimed or the equivalence thereof.

What is claimed is:

1. A pair of screwdrivers each having a handle, a nondetachable outer shaft, a detachable inner shaft, and at least two detachable double-ended screwdriver bits;

Each said screwdriver handle formed having a hollow space configured to substantially house the outer screwdriver shaft, the inner screwdriver shaft, and the at least two double-ended screwdriver bits of the other screwdriver, whereby, the pair of screwdrivers may be assembled together when not in use so that the outer shaft, the inner shaft, and the at least two double-ended screwdriver bits of both screwdrivers are substantially non-exposed to prevent the potential for accidental user injury, each said nondetachable outer screwdriver shaft extending out of and being nondetachable from said handle, said outer screwdriver shaft having a hexagonally shaped opening when viewed from an end view thereof, said hexagonally shaped opening having an inner diameter;

each said detachable inner screwdriver shaft having a hexagonally shaped opening at each end thereof, said inner screwdriver shaft having an outer diameter and an inner diameter when viewed from an end view thereof, the outer diameter of said inner screwdriver shaft being less than the inner diameter of said outer screwdriver shaft, whereby, said inner screwdriver shaft may be detachably inserted into and out of the hexagonally shaped opening of said outer screwdriver shaft, each said inner screwdriver shaft further being formed with an outer configuration preventing rotation within the hexagonally shaped opening of said outer screwdriver shaft;

each of said at least two detachable double-ended screwdriver bits having two ends and an outer diameter when viewed from an end view thereof, the outer diameter of each said screwdriver bit being less than the inner diameter of said inner screwdriver shaft, whereby, each screwdriver bit may be detachably inserted into and out of the hexagonally shaped opening of said inner screwdriver shaft with one end of said screwdriver bit exposed for usage thereof, each said double-ended screwdriver bit further being formed with an outer configuration preventing rotation of said screwdriver bit within the hexagonally shaped opening of said inner screwdriver shaft, each of said at least two double-ended screwdriver bits having two screwdriver tips one at each end thereof, each of said tips being configured to control the rotation of a fastener such as a screw; and, at least one said screwdriver being formed having means to detachably secure the pair of screwdrivers together when assembled.

2. The pair of screwdrivers of claim 1 wherein each said inner shaft is formed with a means to be detachably secured within the outer screwdriver shaft of said screwdriver.

3. The pair of screwdrivers of claim 1 wherein each said double-ended screwdriver bit is formed with a means to be detachably secured within an end of the inner screwdriver shaft of said screwdriver.

4. The pair of screwdrivers of claim 1 wherein together they comprise at least two different screwdriver shaft inner hexagonal openings, and at least eight different screwdriver tips.

5. The pair of screwdrivers of claim 1 wherein a magnetic means is used to detachably secure the two screwdrivers together when assembled.

6. The pair of screwdrivers of claim 1 wherein at least one spring-loaded ball is used to detachably secure the two screwdrivers together when assembled.

7. The pair of screwdrivers of claim 1 wherein a frictional means is used to detachably secure the two screwdrivers together when assembled.

8. The pair of screwdrivers of claim 1 wherein the two assembled screwdrivers have a silhouette shape when viewed from a top view thereof, and the silhouette shape is substantially an elongated ellipse.

9. The pair of screwdrivers of claim 2 wherein each said double-ended screwdriver bit is formed with a means to be detachably secured within an end of the inner screwdriver shaft of said screwdriver.

10. The pair of screwdrivers of claim 2 wherein together they comprise at least two different screwdriver shaft inner hexagonal openings, and at least eight different screwdriver tips.

11. The pair of screwdrivers of claim 2 wherein a magnetic means is used to detachably secure the two screwdrivers together when assembled.

12. The pair of screwdrivers of claim 2 wherein at least one spring-loaded ball is used to detachably secure the two screwdrivers together when assembled.

13. The pair of screwdrivers of claim 2 wherein a frictional means is used to detachably secure the two screwdrivers together when assembled.

14. The pair of screwdrivers of claim 2 wherein the two assembled screwdrivers have a silhouette shape when viewed from a top view thereof, and the silhouette shape is substantially an elongated ellipse.

15. The pair of screwdrivers of claim 3 wherein together they comprise at least two different screwdriver shaft inner hexagonal openings, and at least eight different screwdriver tips.

16. The pair of screwdrivers of claim 3 wherein a magnetic means is used to detachably secure the two screwdrivers together when assembled.

17. The pair of screwdrivers of claim 3 wherein at least one spring-loaded ball is used to detachably secure the two screwdrivers together when assembled.

18. The pair of screwdrivers of claim 3 wherein a frictional means is used to detachably secure the two screwdrivers together when assembled.

19. The pair of screwdrivers of claim 3 wherein the two assembled screwdrivers have a silhouette shape when viewed from a top view thereof, and the silhouette shape is substantially an elongated ellipse.

20. The pair of screwdrivers of claim 4 wherein a magnetic means is used to detachably secure the two screwdrivers together when assembled.

* * * * *